US006571956B2

(12) United States Patent
Mann

(10) Patent No.: US 6,571,956 B2
(45) Date of Patent: Jun. 3, 2003

(54) EAR PIERCING CARTRIDGE AND CLUTCH HOLDER KIT

(75) Inventor: Samuel J. Mann, Englewood, NJ (US)

(73) Assignee: Cookson Group PLC (GB)

( * ) Notice: Subject to any disclaimer, the term of this patent is extended or adjusted under 35 U.S.C. 154(b) by 0 days.

(21) Appl. No.: 09/750,239

(22) Filed: Dec. 28, 2000

(65) Prior Publication Data

US 2002/0084207 A1 Jul. 4, 2002

(51) Int. Cl.[7] ..... B65D 69/00
(52) U.S. Cl. ..... 206/581; 206/823
(58) Field of Search ..... 206/223, 570, 206/581, 438, 823, 561, 565; 220/524, 529, 592

(56) References Cited

U.S. PATENT DOCUMENTS

| | | | | | |
|---|---|---|---|---|---|
| 3,943,935 | A | | 3/1976 | Cameron | |
| 4,030,507 | A | | 6/1977 | Mann | |
| 4,221,295 | A | * | 9/1980 | Tuchband et al. | 206/569 |
| 4,453,785 | A | * | 6/1984 | Smith | 206/307.1 |
| 4,479,762 | A | * | 10/1984 | Bilstad et al. | 206/364 |
| 4,643,306 | A | * | 2/1987 | Ryan | 206/425 |
| 4,832,198 | A | * | 5/1989 | Alikhan | 206/438 |
| 4,860,747 | A | | 8/1989 | Sciara | |
| 4,931,060 | A | | 6/1990 | Aue | |
| 5,004,470 | A | | 4/1991 | Mann | |
| 5,004,471 | A | | 4/1991 | Mann | |
| 5,007,918 | A | | 4/1991 | Mann | |
| 5,148,942 | A | * | 9/1992 | Snook | 220/533 |
| 5,167,343 | A | * | 12/1992 | Winfrey | 220/529 |
| 5,263,960 | A | | 11/1993 | Mann | |
| 5,311,993 | A | * | 5/1994 | Koch | 206/307.1 |
| 5,350,394 | A | | 9/1994 | Mann | |
| 5,360,434 | A | | 11/1994 | Mann | |
| 5,427,222 | A | * | 6/1995 | Miura et al. | 198/345.3 |
| 5,441,514 | A | | 8/1995 | Durham | |
| 5,496,343 | A | | 3/1996 | Reil | |
| 5,499,993 | A | | 3/1996 | Blomdahl et al. | |
| 5,657,925 | A | * | 8/1997 | Norris | 229/120.13 |
| 5,706,966 | A | * | 1/1998 | Rothe | 206/563 |
| 5,718,245 | A | * | 2/1998 | Horn | 206/570 |
| 5,792,170 | A | | 8/1998 | Reil | |
| 5,853,239 | A | * | 12/1998 | Laib et al. | 220/4.33 |
| 5,868,771 | A | | 2/1999 | Herbert et al. | |
| 5,884,782 | A | * | 3/1999 | Dembicks | 211/70.6 |
| 5,979,658 | A | * | 11/1999 | Allen et al. | 206/572 |
| 6,003,673 | A | * | 12/1999 | Vieu | 206/581 |
| 6,257,436 | B1 | * | 7/2001 | McGlauflin | 220/533 |

* cited by examiner

*Primary Examiner*—Shian Luong
(74) *Attorney, Agent, or Firm*—Weingram & Associates, P.C.

(57) ABSTRACT

A kit for an ear piercing cartridge includes a container having preferably a plurality of chambers or cells therein, in each of which is disposed a retaining assembly adapted to releasably receive an ear piercing cartridge. A portion of the retaining assembly is removable so that an ear piercing cartridge having different dimensions can be removably mounted in the same cell. The cassette has double sidewall construction to protect the cells which are hermetically sealed with a material sheet displaceable to access a particular one of the cells.

6 Claims, 4 Drawing Sheets

EAR PIERCING CARTRIDGE AND CLUTCH HOLDER KIT

BACKGROUND OF THE INVENTION

1. Field of the Invention

The present invention relates to containers and kits constructed to hold an earring cartridge and clutch holder and in particular, to those apparatus and kits adapted to be modified after manufacture to accommodate a cartridge having a different size.

2. Description of the Related Art

Ear piercing cartridges are known to be contained and transported for use in plastic containers or packets. For example, U.S. Pat. No. 4,860,747 to Sciara discloses a blister pack which can be readily engaged with the jaws of an ear piercing instrument.

U.S. Pat. Nos. 5,792,170 and 5,868,774 to Reil disclose a blister package for handling the cartridge of an ear piercing system. The blister pack is constructed so that a cartridge can be mounted to a piercing gun and removed therefrom without actually contacting the cartridge.

However, the packs disclosed in Sciara and Reil are specifically constructed for a cartridge type having particular dimensions, i.e. the same pack will not accommodate cartridges with different shapes and features. The pack is constructed of a flexible material so that the user can conform the pack to the cartridge to mount the cartridge to the piercing gun and remove it upon completion of a piercing operation.

OBJECTS AND SUMMARY OF THE INVENTION

It is an object of the present invention to provide a holder kit for an earring cartridge and clutch wherein the kit is adapted to be modified after construction to receive earring cartridges with clutches of a different size.

It is another object of the present invention to provide a holder kit which is constructed with an internal retainer assembly adapted to receive one or a plurality of earring cartridges.

It is another object of the present invention to provide a holder kit having a plurality of sealed chambers or cells in which the earring cartridges are retained.

It is another object of the present invention to provide a holder kit wherein chambers for the earring cartridges are constructed and arranged to retain the earring cartridges in a fixed position.

It is another object of the present invention to provide a holder kit having a plurality of chambers which are sealed to maintain a sterile environment for earring cartridges retained in the chambers until used as intended.

It is another object of the present invention to provide a holder kit having a plurality of hermetically sealed chambers in which each of the chambers is individually accessible without impacting upon the hermetic seal or contents of the remaining chambers.

It is another object present invention to provide a holder kit constructed of a substantially transparent material so that the holding chambers of the kit are readily viewable from an exterior thereof.

It is another object of the present invention to provide a holder kit containing a hygienic cleansing towelette for use in conjunction with an ear piercing operation.

A kit for an ear piercing cartridge is provided which includes a container having preferably a plurality of chambers or cells therein, in each of which is disposed a retaining assembly adapted to releasably receive an ear piercing cartridge. The retaining assembly is constructed and arranged to restrict movement of the cartridge in the corresponding cell. A portion of the retaining assembly is removable so that an ear piercing cartridge having a different size and construction can be removably mounted in the cell. The construction of the kit enables the same kit to be used with cartridges of different sizes. The cassette is provided with double wall protection for the cells which are hermetically sealed with a sheet-like covering displaceable to access a particular one of the cells.

BRIEF DESCRIPTION OF THE DRAWINGS

For a more complete understanding of the present invention, reference may be had to the following description of exemplary embodiments of the present invention considered in connection with the accompanying drawings, of which.

DETAILED DESCRIPTION OF THE PREFERRED EMBODIMENTS

Figure 1:
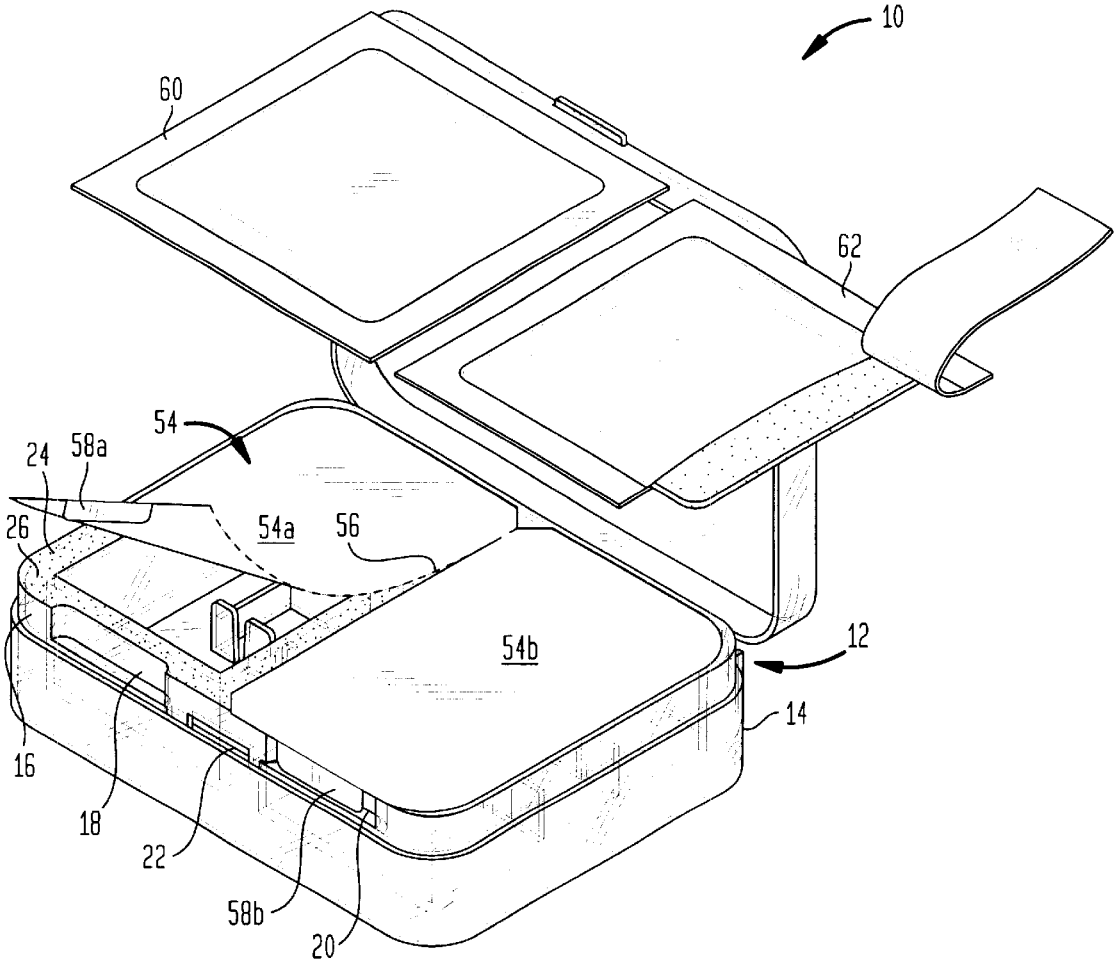
FIGS. 1–4 are views of a preferred embodiment of an earring cartridge and clutch holder kit according to the present invention.
Figure 2:
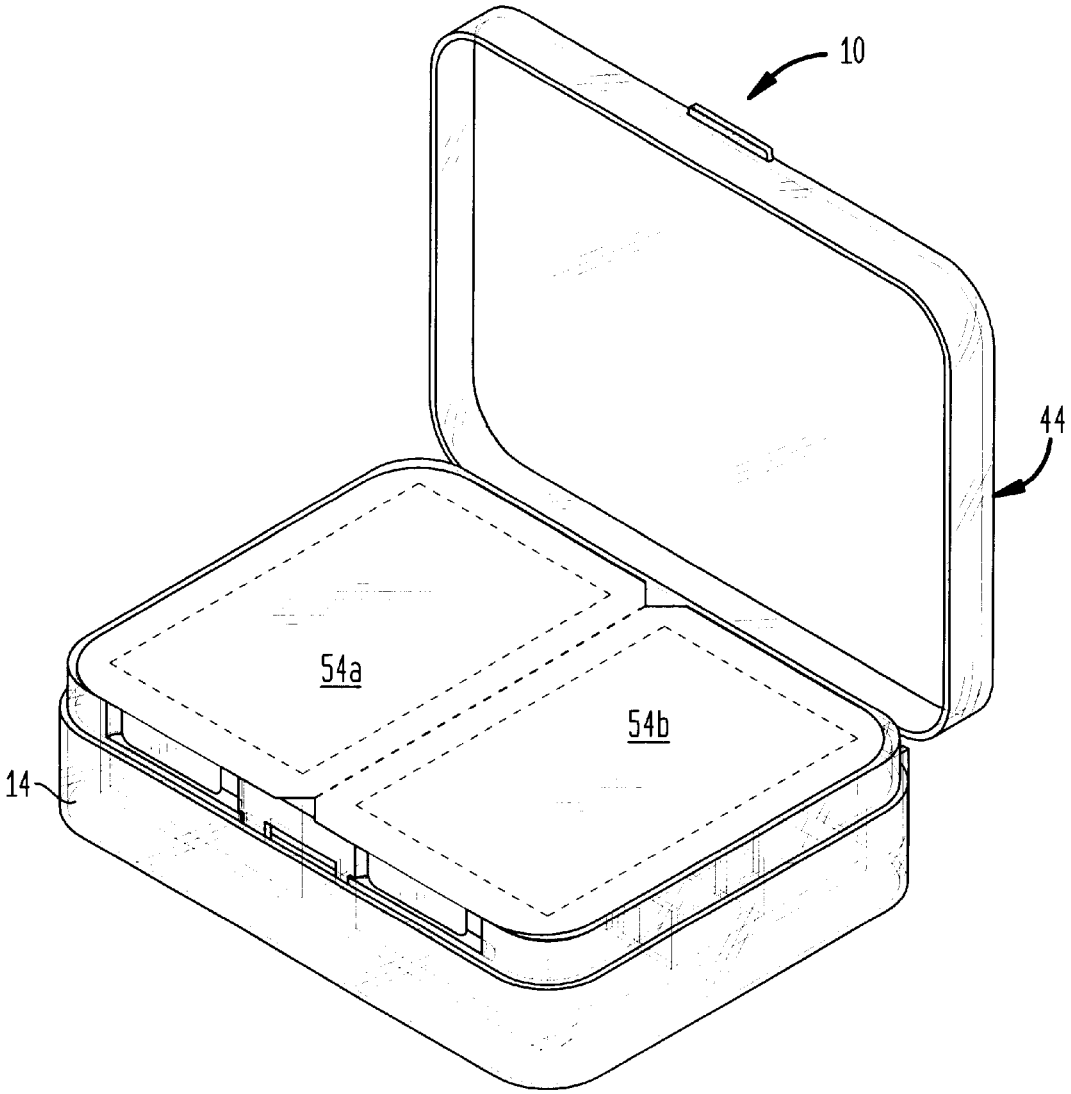

Referring to FIGS. 1 and 2, an earring cartridge and clutch holder kit according to the present invention is shown generally at 10.

The kit 10 includes a cassette 12 or container with an outer sidewall 14. The outer sidewall 14 is formed with a step portion 16 which extends to depressed regions 18,20 having a purpose described below. An aperture 22 is formed at the front of the cassette 12 adjacent the step portion 16 between the depressed regions 18,20.

The sidewall 14 above the step portion 16 is turned inward toward an interior of the cassette 12 to provide a flange 24 or sealing surface along which an adhesive 26 is deposited.

Figure 3:
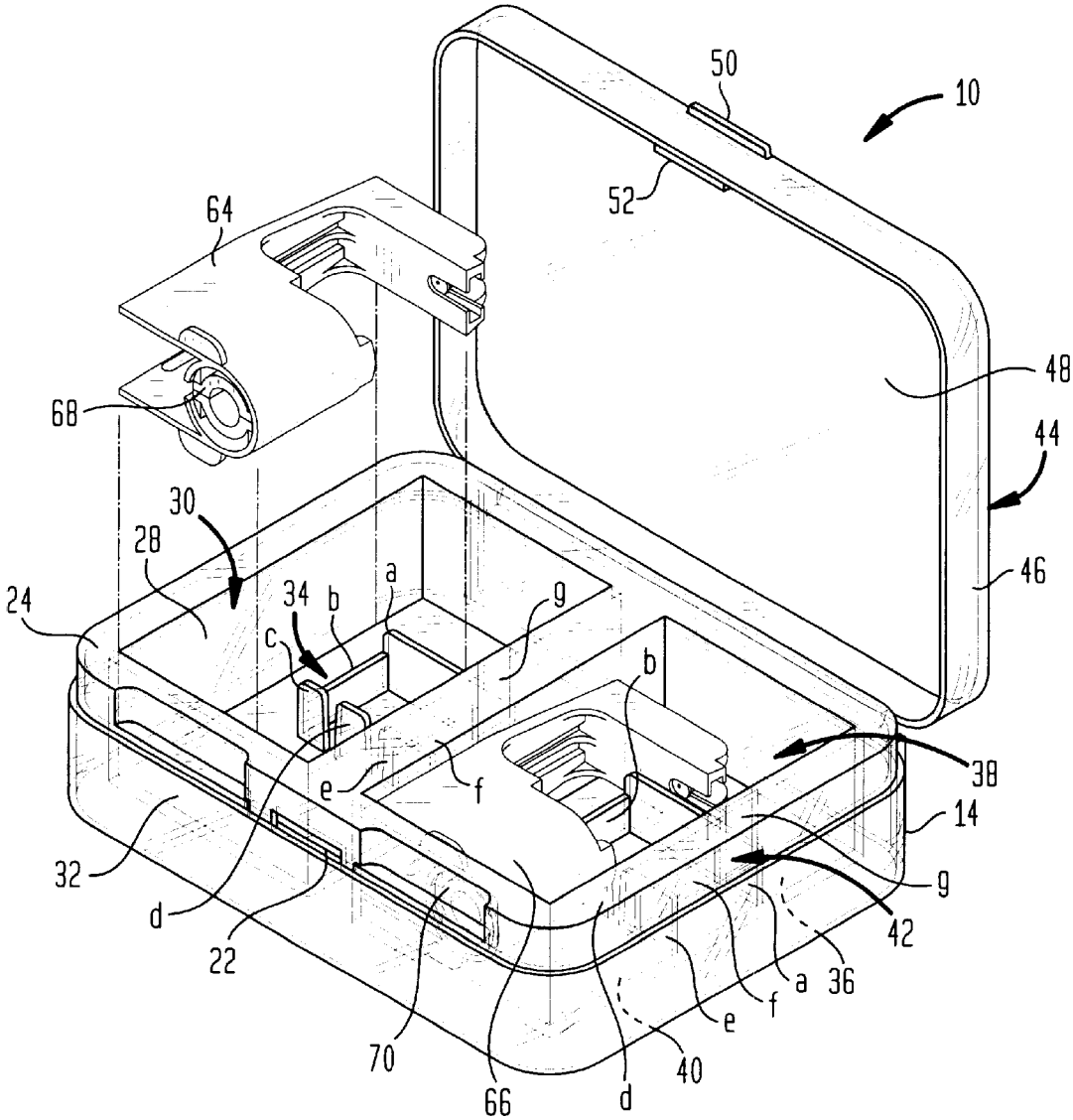
Figure 4:
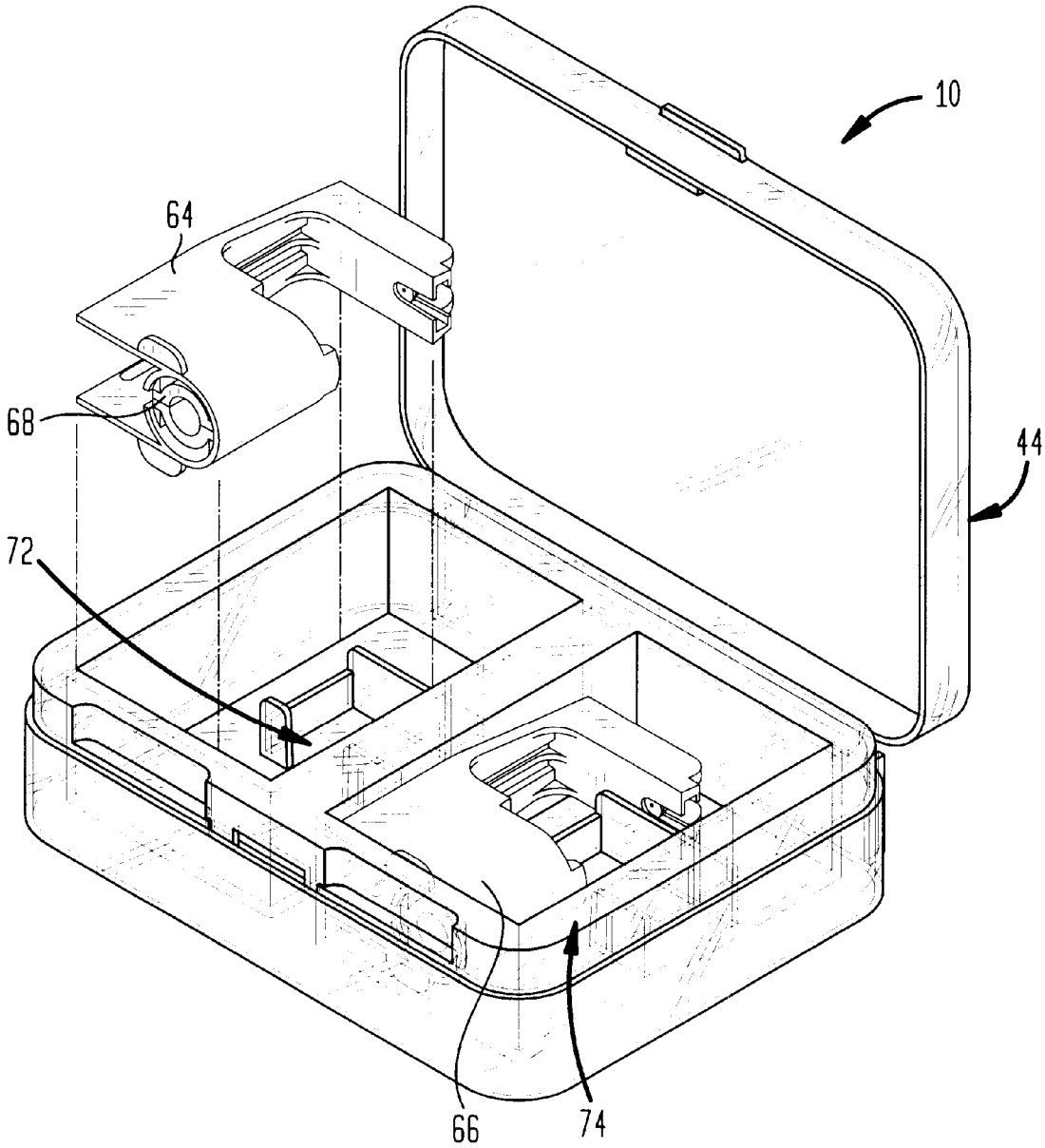

Referring also to FIGS. 3 and 4, inner sidewalls 28,36 spaced from sidewall 14, extend from corresponding portions of the flange 24 to provide separate walls for inner cells 30,38. The inner sidewalls 28,36 extend downward to a corresponding cell bottom 32,40 or floor for each of the inner cells 30,38.

Each one of the inner cells 30,38 is provided with a corresponding retaining assembly 34,42 of members 34*a–g*, 42*a–g* which extend in a pre-arranged pattern from a respective one of the cell floors 32,40. Member 42*c* is obscured by the cartridge 66. The retaining members 34,42 are constructed and arranged to receive and retain ear piercing cartridges 64,66. As shown in FIG. 3, the retaining members 34*a–g*,42*a–g* are disposed to releasably retain the cartridges 64,66 having particular dimensions. The retaining members are interconnected, except for members 34*d*,42*d* which, as frangible tabs, are mounted to the cell bottom 32,40 separate and discrete from the remaining members.

A lid 44 or top is hingedly connected to the cassette 12. The lid 44 includes a sidewall 46 sized and shaped to rest against the sidewall 14 of the cassette 12 and abut the step portion 16. In this manner of construction, when the lid 44 is closed against the cassette 12, there is a smooth uniform exterior for the kit 10 at the interface of the outer sidewall 14 and the lid sidewall 46. A space 48 defined by the lid sidewall 46 is sized and shaped to provide clearance sufficient for a purpose to be described hereinafter.

A tab 50 extends from the lid sidewall 46 to facilitate displacing the lid 44 from the cassette 12. A finger 52 extending from the lid sidewall 46 toward the space 48 is constructed and arranged to releasably engage the aperture 22 of the outer sidewall 14 at the step portion 16.

Referring to FIGS. 1, 2, a covering member 54 includes sections 54*a*,54*b* or sheets which cover respective ones of the inner cells 30,38. The sheets 54*a*,54*b* are secured to the flange 24 over a respective one of the cells 30,38 by the adhesive 26. Scoring 56 or lines of weakness along the cover member 54 define the pair of sheets 54*a*,54*b*, and along which a respective one of the sheets 54*a*,54*b* can be individually removed from the flange to provide access to the corresponding cell 30,38.

Each one of the sections 54*a*,54*b* is provided with a finger tab 58*a*,58*b* extending therefrom which is grasped to displace the section 54A,54B along the scoring 56 against the adhesive 26 to expose the corresponding cell 30,38.

One or a plurality of sealed sterile pad packages 60,62 are disposed on top of the covering member 54. The space 48 of the lid 44 is of a sufficient size and shape so that when the lid 44 is closed onto the cassette 12, the packages 60,62 can be retained in the space 48.

During an ear piercing operation, the tab 50 is pulled to hingedly open the lid 44 from the cassette 12. The particular tab 58*a*,58*b*, is selected and pulled away from the adhesive 26, the pulling operation fracturing the scoring 56 to expose one of the inner cells 30,38. The remaining one of the cells 30,38 remains intact until needed. Thereafter, the ear piercing cartridge 64,66 is removed from the respective one of the retaining members 34,42. The retaining members 34,42 permit the corresponding cartridges 64,66 to be removably mounted in the respective one of the inner cells 30,38.

The cartridges 64,66 are manufactured separate from the cassette 12 and therefore, are manufactured separately from the retaining members 34,42. In certain instances, the cartridge 64,66 is provided with the earring inner holder 68,70 as shown for example in FIGS. 3, 4. In certain cartridge models, the inner holder 68,70 may have different sizes. However, the cassette 12 is mass produced on a cost-effective basis with retaining members 34,42 of similar construction. Accordingly, the retaining members 34*d*,42*d* are removable to accommodate inner holder 68,70 having a different shape, i.e. protruding further from the corresponding one of the cartridges 64,66. During the assembly of the kit 10, if the cartridge 64,66 to be used has an inner holder 68,70 of larger dimensions, the corresponding retaining member 34*d*,42*d* is removed to provide a slot or gap 72,74 in FIG. 4 to accommodate the larger inner holder 68,70. The members 34*d*,42*d* are separately and discretely mounted to the cell bottoms so that removal of the members 34*d*,42*d* will not compromise the structural integrity of the remaining members.

The kit 10 is provided with the double sidewall construction, i.e. the outer sidewall 14 and the inner sidewalls 28,36 of the corresponding inner cells 30,38, to protect the cartridges 64,66.

It will be understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. A kit for piercing an ear, comprising:

a container including:

a first sidewall of substantially transparent material, a second sidewall of substantially transparent material, said second sidewall spaced apart from said first sidewall of said container and extending to form an open ended chamber, a flange interconnecting said first and second sidewalls, and extending around said open ended chamber, adhesive disposed along said flange, a lid hingedly connected to said container for covering said chamber;

an ear piercing cartridge adapted for being disposed in said chamber;

retainer assembly including:

a plurality of members extending from said chamber in a first pattern for releasably receiving said ear piercing cartridge, at least one of said plurality of members removable from said first pattern to provide a second pattern having a gap therein;

a material sheet extending across said chamber and attached to said flange by said adhesive for sealing said chamber with said cartridge therein, said material sheet having:

a line of weakness along which said material sheet is displaced to access said chamber, a tab member extending from said material sheet to be pulled and displace said material sheet along the lines of weakness; and a sterilizing pack supported on said material sheet for sterilizing an earlobe.

2. A kit for an ear piercing cartridge, comprising:

a container having outer side walls and inner side walls spaced from said outer side walls;

a sealing surface connecting upper surfaces of said outer and inner side walls;

a bottom wall connecting lower surfaces of said inner side walls, said inner side walls and bottom wall forming a chamber having an opening at the upper surfaces;

retainer members mounted on the bottom wall within said chamber for receiving and positioning an ear piercing cartridge therein, said retaining members including:

a frangible, removable portion permitting receipt of a differently sized ear piercing cartridge when said portion is removed;

a top cover hingedly secured to the upper surface of one of said outer side walls and;

sterilizing means disposed in said container beneath said top cover and above said sealing surface.

3. A kit for an ear piercing cartridge comprising;

a container with a chamber formed in said container to receive an ear piercing cartridge, said chamber including side walls and a bottom wall;

a top hingedly connected to the container to cover and provide access to said chamber, retainer members mounted on the bottom wall in said chamber in a first pattern for releasably receiving an ear piercing cartridge, the retainer members including a portion adapted to be removed therefrom for providing a second pattern adapted to releasably receive an ear piercing cartridge having other dimensions, a material sheet extending to cover said chamber and releasably secured to said container, said material sheet constructed and arranged for displacement from said container to provide access to said chamber, and a tab extending from said material sheet for displacing the material sheet from said container, said side walls of said container including a depression receiving said sheet tab.

4. A kit for an ear piercing cartridge comprising:

a container with a chamber formed in said container to receive an ear piercing cartridge, said chamber including side walls and a bottom wall;

a top hingedly connected to the container to cover and provide access to said chamber;

retainer members mounted on the bottom wall in said chamber in a first pattern for releasably receiving an ear piercing cartridge, the retainer members including a frangible portion adapted to be removed therefrom for providing a second pattern adapted to releasably receive an ear piercing cartridge having other dimensions, and sterilizing means disposed in said container beneath said top and above said sealing surface.

5. The kit according to claim 4, wherein the sterilizing means, comprises:

a package containing a sterilized pad.

6. The kit according to claim 4, wherein said lid further comprises:

a recessed area constructed and arranged for receiving said sterilizing means.

* * * * *